US006637856B2

(12) United States Patent
Nishi et al.

(10) Patent No.: US 6,637,856 B2
(45) Date of Patent: Oct. 28, 2003

(54) INKJET HEAD AND INKJET PRINTER

(75) Inventors: Shota Nishi, Kanagawa (JP); Makoto Ando, Tokyo (JP); Shigeyoshi Hirashima, Kanagawa (JP); Shinichi Horii, Kanagawa (JP); Hiroshi Tokunaga, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/075,695

(22) Filed: Feb. 14, 2002

(65) Prior Publication Data

US 2002/0126176 A1 Sep. 12, 2002

(30) Foreign Application Priority Data

Feb. 21, 2001 (JP) ..... 2001-045271

(51) Int. Cl.[7] ..... B41J 2/165
(52) U.S. Cl. ..... 347/29; 347/33
(58) Field of Search ..... 347/22, 29, 33, 347/32

(56) References Cited

U.S. PATENT DOCUMENTS 5,040,000 A 8/1991 Yokoi
5,557,306 A 9/1996 Fukushima et al.
5,896,144 A 4/1999 Kishimoto et al.
6,082,848 A 7/2000 Taylor

FOREIGN PATENT DOCUMENTS

EP B2 0410691 1/1991
EP 0867295 9/1998
EP B1 0896881 2/1999
JP 10016316 1/1998

*Primary Examiner*—Huan Huu Tran
(74) *Attorney, Agent, or Firm*—Sonnenschein, Nath & Rosenthal LLP

(57) ABSTRACT

An inkjet head includes a head cap for protecting an ink discharge surface of a print head and a cleaning roller for cleaning the ink discharge surface of the print head. The head cap moves relative to and is removably mounted to the print head including the ink discharge surface with an ink discharge hole for discharging ink supplied from an ink cartridge. The cleaning roller is provided at a print head side of the head cap in the longitudinal direction of the print head. By virtue of this structure, it is possible to reduce the size of a printer body. The invention aims at reducing the size of the printer body by providing the cleaning member at the head cap for protecting the ink discharge surface.

14 Claims, 13 Drawing Sheets

INKJET HEAD AND INKJET PRINTER

RELATED APPLICATION DATA

The present application claims priority to Japanese Application(s) No(s). P2001-045271 filed Feb. 21, 2001, which application(s) is/are incorporated herein by reference to the extent permitted by law.

BACKGROUND OF THE INVENTION

1. Field of the Invention

The present invention relates to an inkjet head and an inkjet printer, and, more particularly, to an inkjet head and an inkjet printer in which, by providing a cleaning member at a head cap for protecting an ink discharge surface, the body of the printer is reduced in size.

2. Description of the Related Art

Technologies for cleaning an ink discharge surface of an inkjet head with a cleaning member in a related inkjet printer are disclosed in, for example, Japanese Unexamined Patent Application Publication Nos. 57-61574 and 6-255117.

In the technology disclosed in Japanese Unexamined Patent Application Publication No. 57-61574, a serial-type inkjet head is used. This inkjet head reciprocates as a result of being guided in the widthwise direction of a recording sheet by a guide mechanism. In addition, a cleaning roller including an ink absorption layer at its peripheral surface and being rotatably held is provided between a location where photographic printing or printing on the recording sheet is started and a head accommodation location situated outwardly of one side of the recording sheet in the widthwise direction thereof. The ink discharge surface of the inkjet head is cleaned by causing it to come into contact with the cleaning roller when the inkjet head reciprocates when the printing operation starts and ends.

In the technology disclosed in Japanese Unexamined Patent Application Publication No. 6-255117, an inkjet head is formed with a length that allows it to cover the entire width of a recording sheet, and is secured above a transportation path of the recording sheet. An ink-discharge hole is provided in the inkjet head in correspondence with the entire width of the recording sheet. A cleaning roller which rotates while it contacts the entire length of an ink discharge surface of the inkjet head is provided. The cleaning roller is formed of a circular cylindrical resilient material and has a plurality of grooves formed in the outer peripheral surface thereof so as to extend in the axial direction. This cleaning roller is brought into contact with the ink discharge surface of the inkjet head, and rotates while it moves in a parallel direction, with the direction of rotation being in the direction of parallel movement, in order to hold ink in the plurality of grooves, so that the ink discharge surface is cleaned.

In inkjet printers, when photographic printing or printing by the inkjet head is not carried out for a long period of time, ink inside an ink discharge hole of the inkjet head undergoes evaporation drying, thereby resulting in increased viscosity or solidification of the ink, so that it becomes difficult to perform a proper ink discharge operation. In order to prevent this, a "preliminary discharge operation" is carried out at a predetermined time interval or prior to photographic printing or printing in order to subject the ink inside the ink discharge hole to a refreshing operation by, for example, sucking and discharging the ink inside the ink-discharge hole at a predetermined location inside the printer. Such a technology is disclosed in, for example, Japanese Unexamined Patent Application Publication No. 10-278299.

However, in the technology disclosed in Japanese Unexamined Patent Application Publication No. 57-61574, it is necessary to provide the cleaning roller and the inkjet head accommodation location outwardly of one side of a recording sheet in the widthwise direction thereof, so that the size of the printer body in the widthwise direction thereof is increased. In addition, since the cleaning roller is affixed inside the printer body, replacement of the cleaning roller is not easy to carry out and the inside of the printer body may get contaminated because a receiving section for receiving ink which may get spattered during the cleaning of the inkjet head is not provided.

The place where a preliminary discharge operation for subjecting ink inside a ink discharge hole of the inkjet head to a refreshing operation is carried out is situated outwardly of the width of the recording sheet in the direction in which the inkjet head reciprocates, that is, the widthwise direction of the recording sheet. Therefore, a preliminary discharge ink receiving section must be provided at this location. Consequently, as expected, the size of the printer body in the widthwise direction thereof is increased. In addition, since the preliminary discharge ink receiving section is provided so that it cannot be easily mounted and dismounted, it is difficult to, for example, clean it.

In the technology disclosed in Japanese Unexamined Patent Application Publication No. 6-255117, the cleaning roller having a plurality of grooves formed in the outer peripheral surface thereof is brought into contact with the ink discharge surface of the inkjet head, and rotates while it moves in a parallel direction, with the direction of rotation being in the direction of parallel movement. Therefore, although the cleaning performance of scooping up the ink that has adhered to the ink discharge surface is high, there were instances in which the performance of the inkjet head got affected due to wearing of a resin protective layer of an electrode provided at the ink discharge surface. Edges are formed at the grooves of the cleaning roller. Since, by the rotation of the cleaning roller in the direction of movement of the cleaning roller, the edges wear quickly, the cleaning performance is reduced, so that it is difficult to maintain the cleaning performance of the initial condition of the cleaning roller for a long period of time.

Since the ink in the plurality of grooves has no place to go, the cleaning member can no longer provide cleaning performance when the grooves are filled completely with the ink, so that, thereafter, cleaning cannot be performed. In addition, since the cleaning roller is fixed inside the body of the printer, replacement of the cleaning roller is not easy to carry out and the inside of the printer body may get contaminated because a receiving section for receiving ink which may get spattered during the cleaning of the inkjet head is not provided.

Since the inkjet head is formed with a length that allows it to cover the entire width of a recording sheet, and is fixed above a transportation path of the recording sheet, when the place where a preliminary discharge operation for subjecting the ink inside the ink-discharge hole of the inkjet head to a refreshing operation is carried out is situated outwardly of the width of the recording sheet, a preliminary discharge ink receiving section and means for moving the inkjet head in the widthwise direction of the recording sheet must be separately provided at this location. Therefore, the size of the printer body in the widthwise direction becomes large or roughly twice the width of the recording sheet.

SUMMARY OF THE INVENTION

Accordingly, in order to overcome such problems, it is an object of the present invention to provide an inkjet head and an inkjet printer which are constructed so as to reduce the size of a printer body by providing a cleaning member at a head cap for protecting an ink discharge surface.

In order to achieve this object, according to one aspect of the present invention, there is provided an inkjet head comprising a head cap, which moves relative to and is removably mounted to a print head, for protecting an ink discharge surface of the print head; and a cleaning member, provided at a print-head side of the head cap in a longitudinal direction of the print head, for cleaning the ink discharge surface of the print head.

By virtue of such a structure, the ink discharge surface of the print head is protected by the head cap that moves relative to and is removably mounted to the print head, and, using the cleaning member provided at the print head side of the head cap in the longitudinal direction of the print head, the ink discharge surface of the print head is cleaned.

When the structure of the one aspect is used, an ink receiving section for receiving ink preliminarily discharged from an ink discharge hole may be provided at an inner side of the head cap.

By this, the ink preliminarily discharged from the ink discharge hole is reliably held in the ink receiving section of the head cap.

When the structure of the one aspect is used, means for detecting a timing of preliminary discharge from an ink discharge hole of the print head when the head cap moves relative to the print head may be provided at either an ink cartridge or the head cap.

By this, using the detecting means provided at either the ink cartridge or the head cap, it is possible to detect the timing of the preliminary discharge from the ink-discharge hole of the print head when the head cap moves relative to the print head.

When the structure of the one aspect is used, the cleaning member may be formed so as to have a circular cylindrical shape that comes into contact with the entire length of the ink discharge surface of the print head, and may be removably held by the head cap.

By this, the cleaning member removably held by the head cap and formed with a circular cylindrical shape is brought into contact with and cleans the entire length of the ink discharge surface of the print head.

When the cleaning member is formed so as to have a circular cylindrical shape that comes into contact with the entire length of the ink discharge surface of the print head, and is removably held by the head cap, means for biasing the cleaning member towards the ink discharge surface of the print head may be provided at a portion where the cleaning member is held by the head cap.

By this, using the biasing means provided at a portion where the cleaning member is held by the head cap, it is possible to bias the cleaning member towards the ink discharge surface of the print head.

When an ink receiving section for receiving ink preliminarily discharged from an ink discharge hole is provided at an inner side of the head cap, means for preventing the preliminarily discharged ink from being spattered back may be provided at a receiving surface of the ink receiving section.

By this, using the spattering-back preventing means provided at the receiving surface of the ink receiving section, it is possible to prevent the ink preliminarily discharged towards the ink receiving section from spattering back.

According to another aspect of the present invention, there is provided an inkjet printer comprising an inkjet head including an ink cartridge for holding ink of one color or of a plurality of colors therein, a print head including an ink discharge surface including an ink discharge hole for discharging ink supplied from the ink cartridge, a head cap, which moves relative to and is removably mounted to the print head, for protecting the ink discharge surface of the print head, and a cleaning member, provided at a print-head side of the head cap in a longitudinal direction of the print head, for cleaning the ink discharge surface of the print head; a head mounting-and-dismounting mechanism for mounting and securing the inkjet head to a predetermined location of a printer body and for dismounting the inkjet head from the predetermined location of the printer body; and a head cap placing-and-removing mechanism for uncovering the ink discharge surface and for placing the head cap after completion of a printing operation by, with the inkjet head being secured to the predetermined location of the printer body, moving the head cap relative to the print head.

By such a structure, using the head mounting-and-dismounting mechanism, the inkjet head is mounted to and dismounted from a predetermined location of the printer body. Using the head cap placing-and-removing mechanism, while the inkjet head is mounted to the predetermined location of the printer body, the head cap is moved relative to the print head in order to uncover the ink discharge surface and to place the head cap after completion of a printing operation. Using the inkjet head including the ink cartridge, the print head, the head cap, and the cleaning member, ink is formed into very fine particles and the very fine particles are discharged in order to blow ink dots onto a recording sheet, whereby printing is performed.

The inkjet printer may further comprise an ink receiving section, provided at an inner side of the head cap of the inkjet head, for receiving ink preliminarily discharged from the ink discharge hole.

By this, the ink preliminarily discharged from the ink-discharge hole is reliably held at the ink receiving section of the head cap.

DESCRIPTION OF THE PREFERRED EMBODIMENTS

Hereunder, a detailed description of embodiments of the present invention will be given with reference to the attached drawings.

Figure 1:
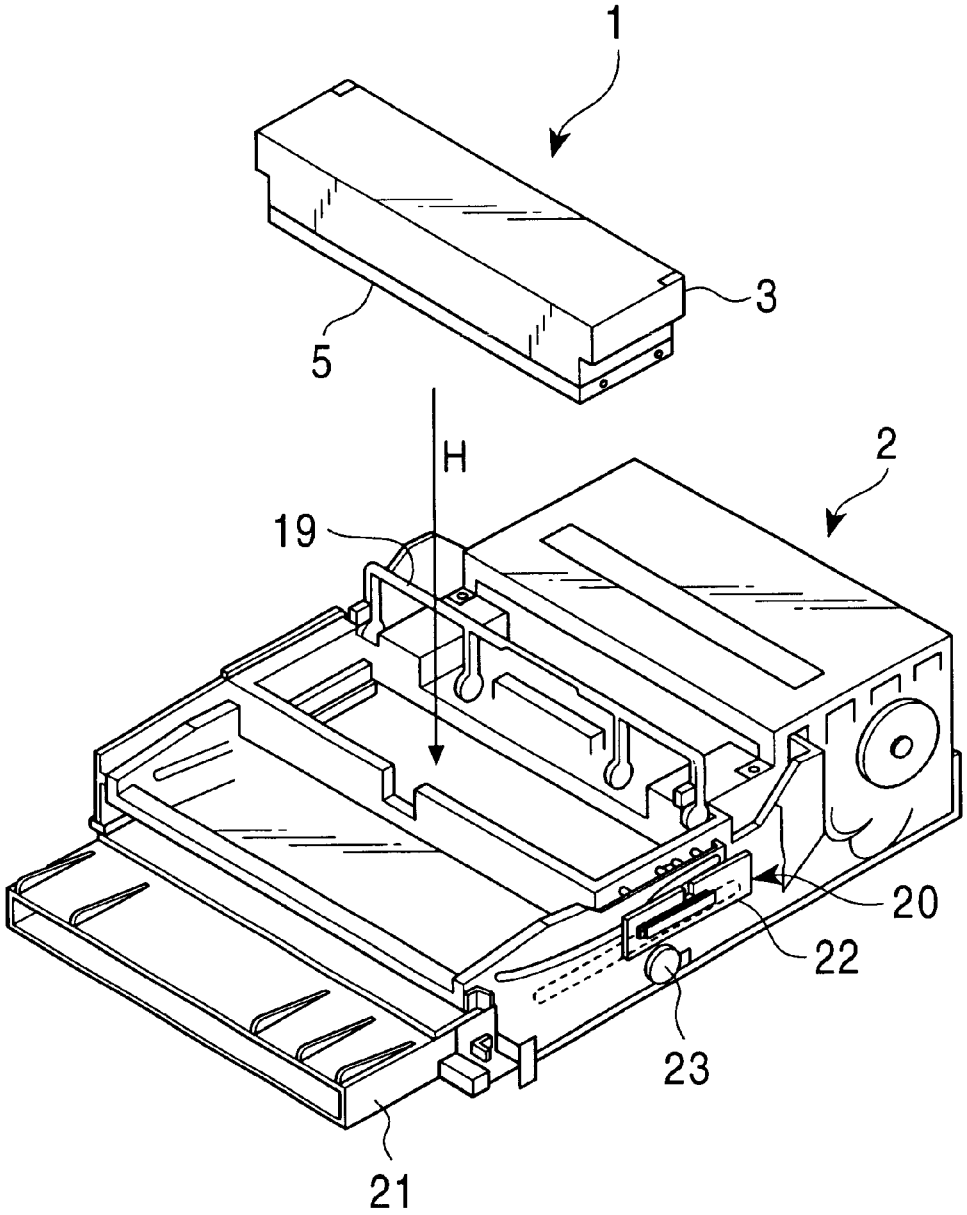
FIG. 1 is a perspective view of an inkjet head of an embodiment of the present invention and a printer body, to which the inkjet head is mounted, of a form used in the present invention.

FIG. 1 is a perspective view of an inkjet head 1 of an embodiment of the present invention and a printer body 2, to which the inkjet head 1 is mounted, of a form used in the present invention. In FIG. 1, the inkjet head 1 is separately formed, and is of a type that is directly mounted to the printer body 2. The inkjet head 1 is accommodated in the direction of arrow H, and is set so as to be fixed to the printer body 2 in order to form an inkjet printer.

Figure 2:
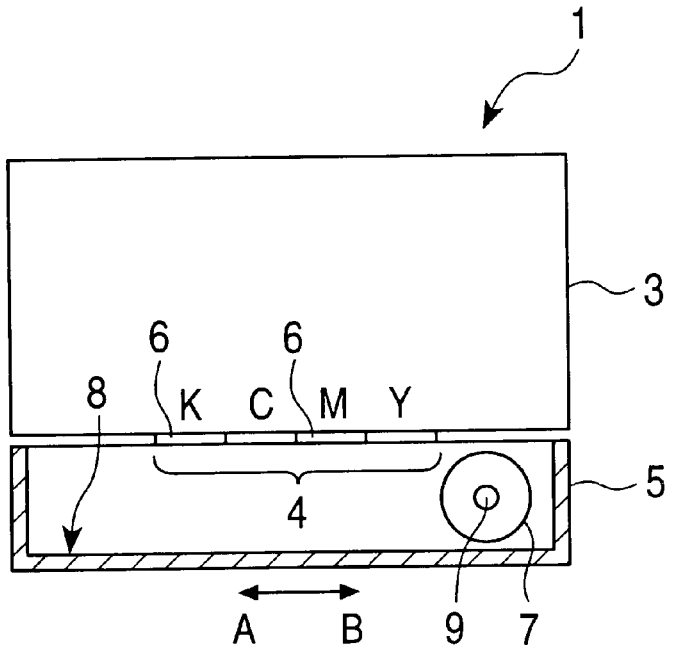
FIG. 2 is an enlarged transverse sectional view of the inkjet head shown in FIG. 1.

The inkjet head 1 forms liquid ink into very fine particles by, for example, electrothermal conversion or electromechanical conversion, and discharges the very fine particles in order to blow ink dots onto a recording sheet. As shown in FIGS. 1 and 2, the inkjet head 1 comprises an ink cartridge 3, a print head 4, and a head cap 5.

The ink cartridge 3 holds ink of one color or of a plurality of colors therein. Its housing is extended so as to be elongated in the widthwise direction of the printer body 2 shown in FIG. 1, that is, over the entire width of a recording sheet in the widthwise direction thereof. Although not shown, four divided ink chambers are formed inside the housing and are filled with ink of corresponding four colors, yellow Y, magenta M, cyan C, and black K. The ink cartridge 3 is formed of, for example, a hard resin.

As shown in FIG. 2 (which is an enlarged transverse sectional view of the inkjet head 1 shown in FIG. 1), the print head 4 is provided at the bottom surface portion of the ink cartridge 3. The print head 4 forms the ink supplied from the ink cartridge 3 into very fine particles, and discharges the very fine particles. The print head 4 includes ink discharge surfaces 6 having very small ink-discharge holes provided in correspondence with the entire width of a recording sheet along the longitudinal direction of the ink cartridge 3. The ink discharge surfaces 6 extend in the longitudinal direction of the ink cartridge 3, and are provided in correspondence with the four colors of ink, yellow Y, magenta M, cyan C, and black K, respectively. Although not shown, the portions of the ink discharge surfaces 6 that include the ink-discharge holes of the corresponding colors of ink, Y, M, C, and K, and the portions thereof that include protrusions where head electrodes are covered with resin on both sides of the corresponding ink-discharge holes are formed so as to have undulating planar shapes.

The head cap 5 is mounted to the bottom surface of the ink cartridge 3. The head cap 5 covers the ink discharge surfaces 6 of the print head 4 and protects them in order to prevent drying and clogging of the ink-discharge holes. The head cap 5 extends so as to be elongated to the same length as the housing of the ink cartridge 3, has the shape of a box that is shallow and that has an open top side, and moves relative to and is removably mounted to the print head 4. The head cap 5 moves, as indicated by arrows A and B, in a direction orthogonal to the longitudinal direction of the ink discharge surfaces 6 of the print head 4. When the head cap 5 has moved in the direction of arrow A, it is removed from the ink cartridge 3, whereas, when the head cap 5 has moved back in the direction of arrow B, it is placed on the ink cartridge 3 again. The head cap 5 is formed of, for example, a hard resin.

A cleaning roller 7 is provided at the inner side of the head cap 5. The cleaning roller 7 is a cleaning member for cleaning the ink discharge surfaces 6 of the print head 4, and is mounted at one side portion inside the head cap 5 in the longitudinal direction of the head cap 5. Therefore, the cleaning roller 7 is provided parallel to the longitudinal direction of the ink discharge surfaces 6 of the print head 4. The cleaning roller 7 moves in the direction of arrow A along with the head cap 5 in order to clean the ink discharge surfaces 6 of the print head 4.

An ink receiving section 8 is similarly provided at the inner side of the head cap 5. The ink receiving section 8 receives preliminarily discharged ink from the ink-discharge holes of the print head 4, so that part of or the whole bottom surface of the shallow-box-shaped head cap 5 receives the preliminarily discharged ink.

Figure 3:
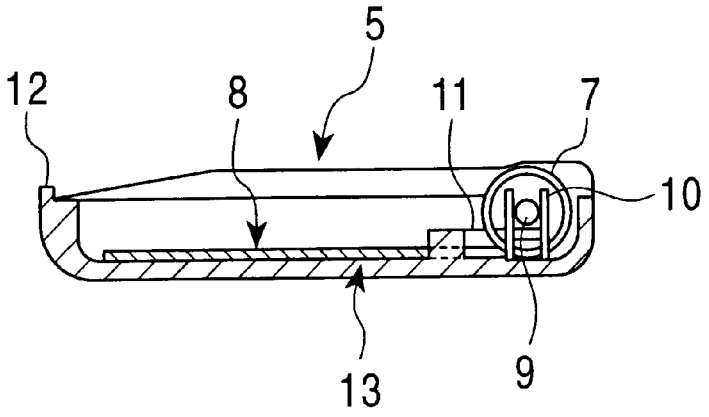
FIG. 3 is a side view of specific examples of a head cap, a cleaning roller, and an ink receiving section shown in FIG. 2.
Figure 4:
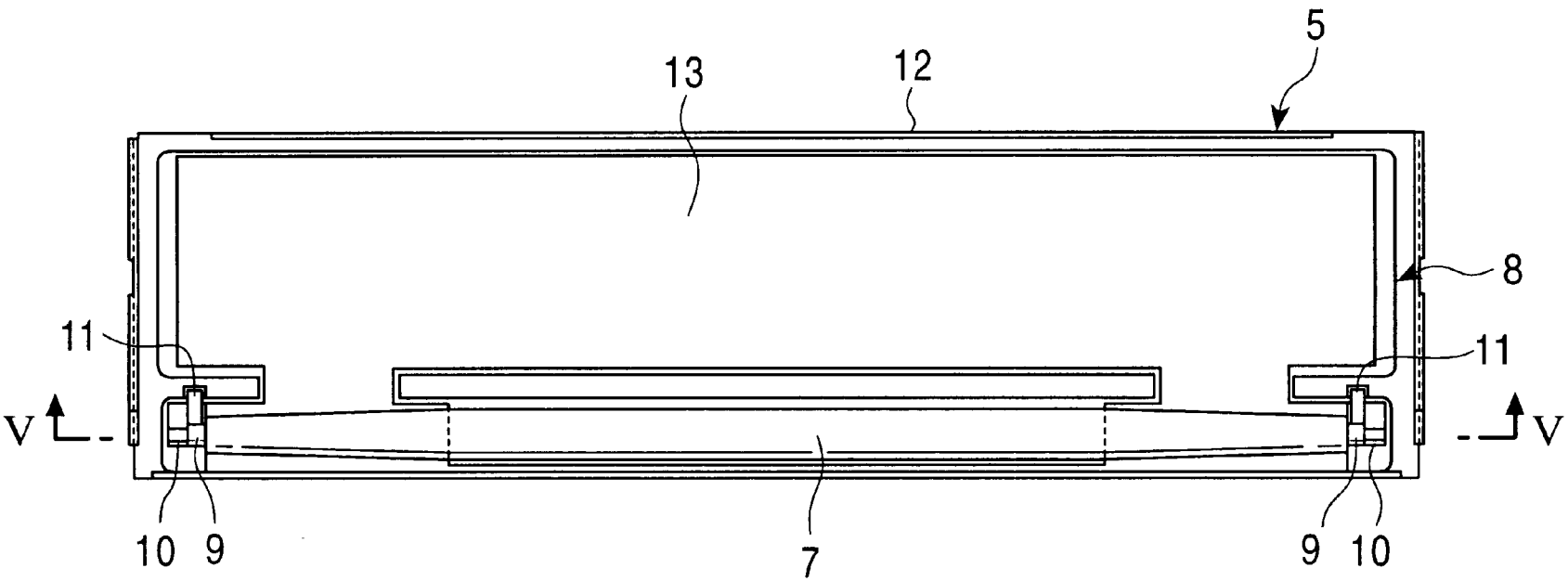
FIG. 4 is a plan view of the specific examples of the head cap, the cleaning roller, and the ink receiving section.

Next, specific examples of the head cap 5, the cleaning roller 7, and the ink receiving section 8 will be described with reference to FIGS. 3 to 5. In FIG. 4, the head cap 5 is formed into an elongated shape in accordance with the width and length of the ink cartridge 3 shown in FIG. 1. As shown in FIG. 3, the head cap 5 is formed with a bottom surface (lower portion) and into the shape of a shallow box in which a side of upstanding portions of side walls along the entire periphery is open. As mentioned above, the head cap 5 moves, as indicated by the arrows A and B, in a direction orthogonal to the longitudinal direction of the ink discharge surfaces 6 of the print head 4. As shown in FIG. 3, as positioning means used when the head cap 5 is placed onto the ink cartridge 3 again after the head cap 5 has moved back in the direction of arrow B, a positioning pawl 12 is provided at the top end portion of a side wall of the head cap 5 opposite to the cleaning roller 7. The positioning pawl 12 positions the head cap 5 as a result of being stopped by a side edge of the lower portion of the ink cartridge 3.

The cleaning roller 7, which is formed into a circular cylindrical shape and which comes into contact with the ink discharge surfaces 6 of the print head 4 over the entire length of the ink discharge surfaces 6, is removably held near one of the side walls of the head cap 5 in the longitudinal direction thereof at the print head 4 side of the head cap 5. More specifically, as shown in FIG. 4, protruding pins 9 are provided at both end portions of the cleaning roller 7, and, as shown in FIG. 3, are held by substantially U-shaped upstanding holding members 10. Pin-receiving sections at the top portions of the holding members 10 can be resiliently widened and narrowed. By pushing the pins 9 against the pin-receiving sections from thereabove, the pin-receiving sections are widened and receive the pins 9, and, thereafter, are narrowed and hold the pins 9. In contrast, by raising the pins 9 upward, the pin-receiving sections are widened, so as to allow removal of the pins 9.

Figure 5:
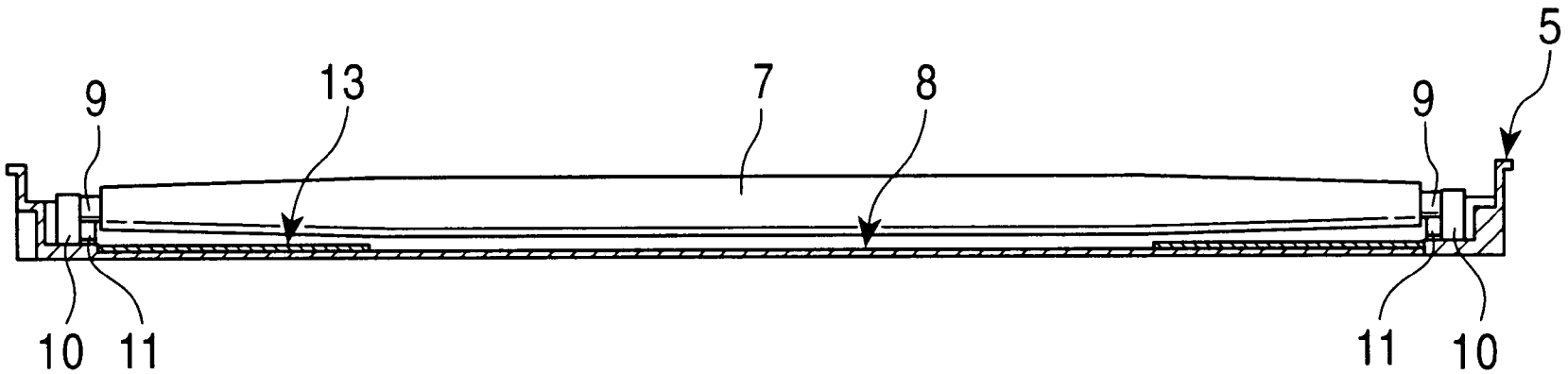
FIG. 5 is a sectional view taken along line V—V of FIG. 4.

As shown in FIGS. 4 and 5, the circular cylindrical shape of the cleaning roller 7 is what is called a crown shape where the central portion in the longitudinal direction thereof is moderately thick. The cleaning roller 7 has this shape to prevent the cleaning roller 7 from moving out of contact with the ink discharge surfaces 6 when the central portion of the cleaning roller 7 in the longitudinal direction thereof flexes downward. The portion of the cleaning roller 7 that comes into contact with the ink discharge surfaces 6 is resilient and is formed of a material that absorbs ink. More specifically, the core material of the cleaning roller 7 is formed of, for example, a metal or a hard resin, while the peripheral portion thereof situated outwardly of the core material is formed of a resilient material and a porous material having an ink absorption property.

As shown in FIG. 3, a floating spring 11 is interposed at the portion where the cleaning roller 7 is held by the head cap 5. The floating spring 11 is means for biasing the cleaning roller 7 towards the ink discharge surfaces 6 of the print head 4; is, for example, a plate spring that is substantially U-shaped in side view; and is inserted below the pins 9 near the holding members 10. By causing the biasing force of the floating spring 11 to act on the pins 9 at both end portions of the cleaning roller 7, the cleaning roller 7 presses against the ink discharge surfaces 6 of the print head 4 with a substantially uniform force.

By this, as shown in FIG. 2, with the head cap 5 being placed on the bottom surface of the ink cartridge 3, the cleaning roller 7 is such as to come into contact with the entire length of the ink discharge surfaces 6 of the print head 4 due to the biasing force of the floating spring 11 and the resilient force and the crown shape of the cleaning roller 7. The floating spring 11 is not limited to a substantially U-shaped plate spring, so that it may be a coil spring.

The cleaning roller 7 is such as to be driven and rotated as a result of coming into contact with the ink discharge surfaces 6 of the print head 4. Therefore, as shown in FIG. 2, when the head cap 5 moves in the direction of arrow A, the cleaning roller 7 rotates while it comes into close contact with the entire length of the ink discharge surfaces 6 of the print head 4 with a proper pressure in order to, by this rotational movement, clean off the ink that has adhered to the ink discharge surfaces 6. In this case, it is possible to clean off the ink without injuring protective layers where head electrodes provided at the ink discharge surfaces 6 are covered with resin.

The cleaning roller 7 may be secured so as not to rotate while it is in contact with any one of the ink discharge surfaces 6 of the print head 4. For example, in FIG. 3, by providing two pins 9 at both end portions of the cleaning roller 7 in the vertical direction, and by inserting the two pins 9 at both end portions into a substantially U-shaped groove of the holding members 10, the cleaning roller 7 is prevented from rotating. In this case, the cleaning roller 7 moves while it rubs against the ink discharge surfaces 6. Therefore, it is possible to clean off solidified ink stuck on the ink discharge surfaces 6, not to mention liquid ink stuck on the ink discharge surfaces 6.

The cleaning roller 7 may be such as to rotate while it rubs against the ink discharge surfaces 6 of the print head 4 by limiting the rotation of the cleaning roller 7 by a braking mechanism. For example, in FIG. 3, the braking mechanism is a mechanism in which a proper resilient member is interposed at the portion where the pins 9 provided at both end portions of the cleaning roller 7 are held by the holding members 10, and in which the pins 9 are press-fitted to a hole formed in the resilient member, or both end surfaces of the cleaning roller 7 are press-contacted to a side surface of the resilient member. The braking mechanism produces a proper braking force when the cleaning roller 7 rotates. In this case, since the cleaning roller 7 rotates slightly while it rubs against the ink discharge surfaces 6, it can clean off solidified ink stuck on the ink discharge surfaces 6, not to mention liquid ink stuck on the ink discharge surfaces 6, without injuring the ink discharge surfaces 6.

As shown in FIGS. 3 to 5, an ink-absorbing member 13 is laid on a receiving surface, or bottom surface, of the ink receiving section 8 at the inner side of the head cap 5. The ink-absorbing member 13 is means for preventing ink preliminarily discharged from the print head 4 from spattering back; is formed of a porous, high molecular material, such as sponge, polyurethane, or polyurethane foam, and; as shown in FIG. 4, is laid over substantially the entire receiving surface of the ink-receiving section 8. However, as shown in FIG. 5, the ink-absorbing member 13 is not laid below the large-diameter central portion of the crown-shaped cleaning roller 7 in order to provide clearance therebelow.

When the ink-absorbing member 13 is laid as described above, the preliminarily discharged ink from the print head 4 shown in FIG. 2 is prevented from spattering back, and the ink can be absorbed thereby so that the ink does not collect at the ink-receiving section 8. Therefore, the problem that the preliminarily discharged ink re-adheres onto the ink discharge surfaces 6 as a result of being spattered back at the ink-receiving section 8 is prevented from occurring. After using the ink-absorbing member 13 for a proper period of time, the ink-absorbing member 13 that has absorbed the preliminarily discharged ink is removed from the ink-receiving section 8 and discarded in order to lay another ink-absorbing member 13, thereby making it possible to easily clean off the preliminarily discharged ink.

Although, in the form shown in FIGS. 3 to 5, the ink-receiving section 8 is described as being provided along the entire bottom surface of the head cap 5, the present invention is not limited thereto, so that the ink-receiving section 8 may be provided along part of the bottom surface of the head cap 5. For example, in FIG. 2, the cleaning roller 7 may be slightly moved towards the center portion, and a partition plate may be provided between a cleaning-roller-7-side side wall of the head cap 5 and the cleaning roller 7 in order to form a chamber surrounded by the partition plate and the side wall as the ink-receiving section 8. In this case, it is possible to limit the location that receives the preliminarily discharged ink from the ink-discharge holes of the print head 4 to a particular location of the head cap 5.

Next, the preliminary discharge of ink from the ink-discharge holes of the print head 4 will be described. The preliminary discharge of ink is carried out to, for example, suck and discharge ink inside the ink-discharge holes prior to printing or photographic printing for the purpose of preventing the problem that normal ink discharge becomes difficult to achieve due to increased viscosity or solidification of ink caused by evaporation drying of the ink inside the ink-discharge holes as described above. The preliminary discharge of ink from the ink-discharge holes towards the ink-receiving section 8 of the head cap 5 before or after cleaning the ink discharge surfaces 6 by the cleaning roller 7. For example, discharging of ink drops from the ink-discharge holes of the print head 4 at a frequency of the order of 10 kHz is repeated a few times in order to carry out the preliminary discharge of ink.

In FIG. 2, when the preliminary discharge of ink is carried out before cleaning the Y, M, C, and K colored ink discharge surfaces 6, it is not necessary to particularly control a timing of the preliminary discharge of the ink from each of the ink-discharge holes, so that the preliminary discharge may be carried out before or after the head cap 5 starts moving, or from each of the colored ink discharge holes simultaneously. In these cases, the preliminary discharge of ink can be easily controlled. However, when, in order to avoid mixing of colors resulting from cleaning the colored ink discharge surfaces 6 using one cleaning roller 7, the preliminary discharge of ink is carried out after cleaning the colored ink discharge surfaces 6, it is necessary to control the timing of the preliminary discharge of ink.

Figure 6:
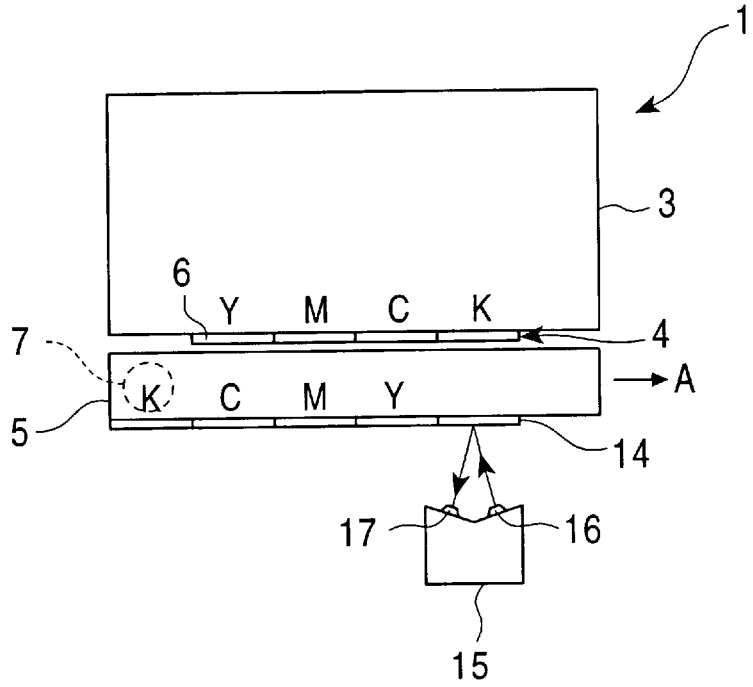
FIG. 6 illustrates means for detecting a timing of a preliminary discharge operation from each ink discharge hole carried out when the head cap moves relative to the print head.

Therefore, as shown in FIG. 6, means for detecting a timing of preliminarily discharging ink from the ink-discharge holes of the print head 4 when the head cap 5 moves relative to the print head 4 is provided at the head cap 5. In FIG. 6, the cap head 5 moves in a direction opposite to that in FIG. 2.

In FIG. 6, the preliminary discharge timing detecting means comprises a position detection sheet 14 provided at the bottom surface side of the head cap 5 and a photoelectric switch 15 opposing the position detection sheet 14 and provided inside the printer body 2 shown in FIG. 1. The position detection sheet 14 is provided for examining locations corresponding to the colored ink discharge surfaces 6 of the print head 4 when the head cap 5 moves in the direction of arrow A, and has, for example, a light and dark pattern formed in correspondence with an arrangement pitch of the Y, M, C, and K ink discharge surfaces 6. The arrangement of the portions of the pattern is opposite to the order of arrangement of each of the colors, Y, M, C, and K for each of the ink discharge surfaces 6. In the initial stage of movement of the head cap 5, the arrangement of the portions of the pattern on the position detection sheet 14 is displaced towards the back when viewed in the direction of arrow A.

The photoelectric switch 15 is provided for detecting the light and dark pattern on the position detection sheet 14 that moves along with the head cap 5, and is formed by integrally combining a light-emitting section 16, such as a light-emitting diode (LED), and a light receiving detecting section 17, which is a photodiode. The light and dark pattern on the position detection sheet 14 changes its reflectivity with respect to the wavelength of light emitted from the light emitting section 16, and the light receiving detecting section 17 is sensitive to the wavelength of the reflected light.

By such a structure, when the head cap 5 moves in the direction of arrow A, so that the position detection sheet 14 at the bottom surface of the head cap 5 passes in front of the photoelectric switch 15, it is possible to detect the light and dark pattern on the position detection sheet 14 in order to examine the locations corresponding to the locations of the Y, M, C, and K ink discharge surfaces 6. By this, the position of the cleaning roller 7 that moves with the head cap 5 is known, and, immediately after cleaning each of the colored ink discharge surfaces 6 by the cleaning roller 7, the timing is controlled so that the preliminary discharge of ink from each of the ink-discharge holes is successively carried out. At this time, the ink that has been preliminary discharged is reliably held inside the ink-receiving section 8.

Figure 7A:
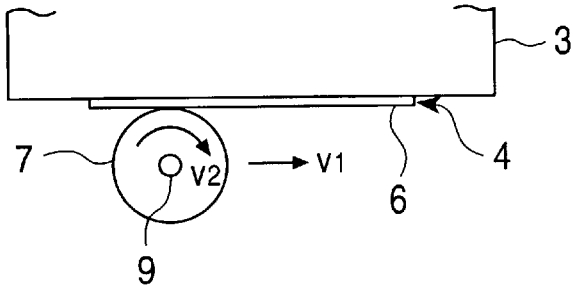
FIGS. 7A and 7B schematically illustrate another form of the cleaning roller.
Figure 7B:
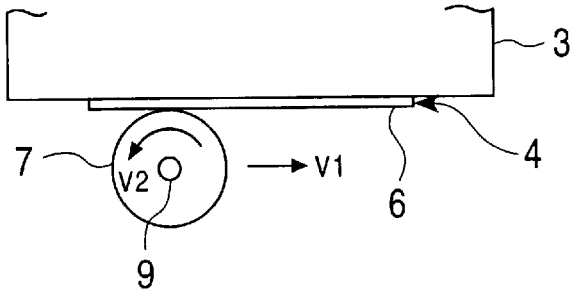

FIGS. 7A and 7B schematically illustrate another form of the cleaning roller 7. In this form, the cleaning roller 7 is such as to rotate forward or backward by a rotation driving mechanism. More specifically, in FIG. 2, a rotary shaft of a motor (not shown) provided inside the printer body 2 is connected to the pins 9, provided at the cleaning roller 7, through a gear mechanism having a proper reduction ratio, so that the cleaning roller 7 is actively rotationally driven.

As shown in FIG. 7A, the cleaning roller 7 is rotated by the motor in the same direction as the direction of movement of arrow A of the head cap 5 shown in FIG. 6 and with a rotating speed that is set so that an outer peripheral speed $v_2$ of the cleaning roller 7 is greater than a movement speed $v_1$ of the head cap 5. In this case, the ink discharge surfaces 6 are reliably cleaned by rubbing that is based on the difference in speeds between the ink discharge surfaces 6 of the print head 4 and the outer peripheral surface of the cleaning roller 7. Even when the motor is rotated with a rotating speed that is set so that the movement speed $v_1$ of the head cap 5 is greater than the outer peripheral speed $v_2$ of the cleaning roller 7, rubbing occurs between the ink discharge surfaces 6 and the outer peripheral surface of the cleaning roller 7 as mentioned above, so that the ink discharge surfaces 6 are reliably cleaned.

As shown in FIG. 7B, the cleaning roller 7 may be made to rotate in a direction opposite to the direction of movement of arrow A of the head cap 5 shown in FIG. 6. In this case, rubbing occurs due to a difference between the directions of movement of the ink discharge surfaces 6 of the print head 4 and the outer peripheral surface of the cleaning roller 7, so that the ink discharge surfaces 6 are reliably cleaned.

Figure 8:
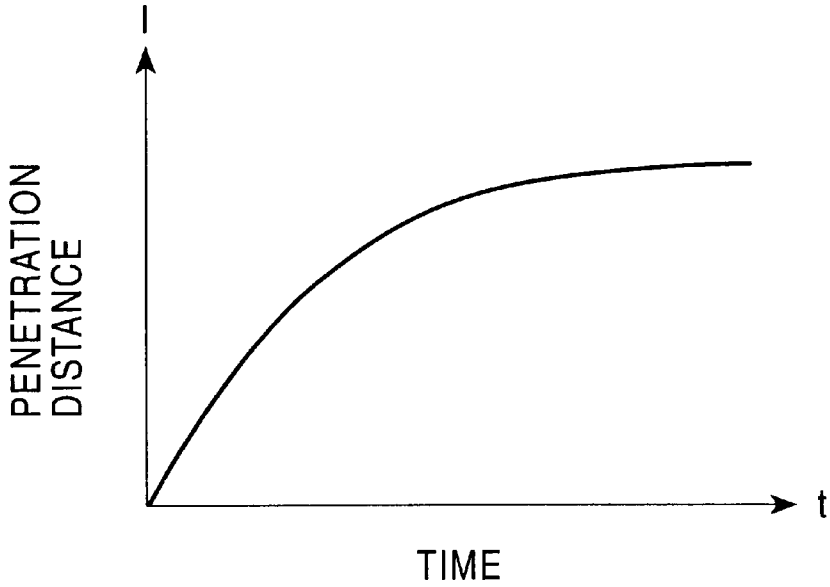
FIG. 8 is a graph showing changes in an ink liquid penetration distance with respect to an ink absorbing member with time.

In the form shown in FIG. 7, the ink discharge surfaces 6 of the print head 4 are cleaned by outer peripheral surface portions that are successively provided by the active rotation of the cleaning roller 7. When this is seen in terms of changes in ink liquid penetration distance with respect to the ink-absorbing member with time when, for example, the circular cylindrical ink-absorbing member has been immersed in the ink liquid, it is known that, as shown in FIG. 8, the rate of increase of a penetration distance l is initially large, but gradually decreases with the passage of time t.

For example, when the radius of the circular cylindrical ink-absorbing member is r, the surface tension of a liquid (ink) is $\gamma$, the viscosity of the liquid is $\eta$, the angle of contact between the liquid and the ink-absorbing member is $\theta$, and the difference in external pressures exerted on both ends of the circular cylindrical ink-absorbing member is $\Delta p$, the penetration distance l is expressed by the following general formula:

$$l^2=(r^2/4\eta)\{(2\gamma\cdot\cos\theta/r)+\Delta p\}t$$

In other words, when, as in the form shown in FIGS. 7A and 7B, rubbing is caused to positively occur between the ink discharge surfaces 6 and the outer peripheral surface of the cleaning roller 7 by a difference in speeds and directions of movement, a cleaning effect in which the possibility of incomplete wiping of the ink discharge surfaces 6 is small can be expected.

Figure 9:
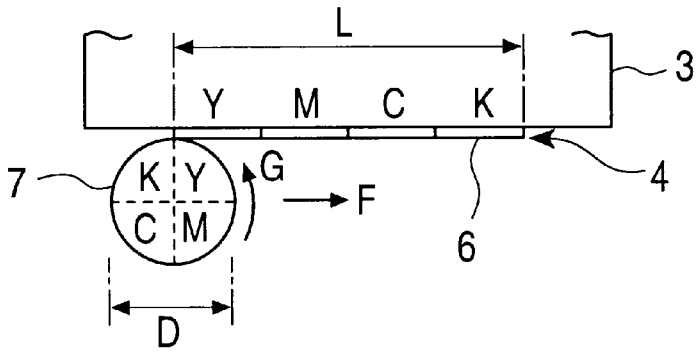
FIG. 9 schematically illustrates still another form of the cleaning roller.

FIG. 9 schematically illustrates still another form of the cleaning roller 7. In this form, the cleaning roller 7 is formed so that the length of the cross-sectional circumference of the cleaning roller 7 is equal to the movement distance covered by the cleaning roller 7 when it is driven and rotates by coming into contact with the ink discharge surfaces 6 of the print head 4. More specifically, in FIG. 9, when a length equal to the total lengths of the ink discharge surfaces 6 in the direction in which a recording sheet is fed is L, and a diameter of the cleaning roller 7 is D, the length of the cross-sectional circumference of the cleaning roller 7 is $\pi D$. Therefore, in this case, the formula $L=\pi D$ is established, so that $D=L/\pi$. In other words, the diameter D of the cleaning roller 7 is determined so that $D=L/\pi$.

By such a structure, as shown in FIG. 9, the Y, M, C, and K colored ink discharge surfaces 6 are always cleaned by the same outer peripheral surface portions as a result of one rotation of the cleaning roller 7 because the outer peripheral surface portions of the cleaning roller 7 roll on the Y, M, C, and K colored ink discharge surfaces 6 as a result of the cleaning roller 7 being driven and rotating in the direction of arrow G while moving in the direction of arrow F. Therefore, a particular outer peripheral surface portion of the cleaning roller 7 always comes into contact with the same ink discharge surface 6, so that mixing of colors in that ink discharge surface 6 does not occur. Therefore, there is no possibility of the quality of printing and photographic printing by the inkjet head getting reduced.

Figure 10:
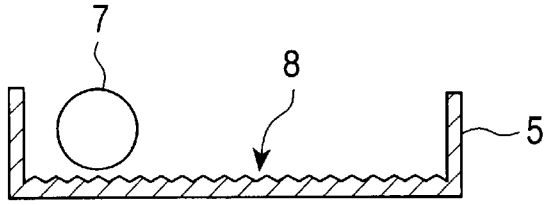
FIG. 10 schematically illustrates another form of the ink receiving section of the head cap.

FIG. 10 schematically illustrates another form of the ink-receiving section 8 provided at the head cap 5. In this form, the receiving surface of the ink-receiving section 8 is formed into a rough surface. The rough surface is means for preventing preliminarily discharged ink from the print head 4 from being spattered back; is, for example, jagged, bumpy, or wavy; and causes the preliminarily discharged ink to be scattered sideways rather than being spattered back upward. By the rough surface, the preliminarily discharged ink is prevented from re-adhering to the ink discharge surfaces 6 of the print head 4.

Figure 11:
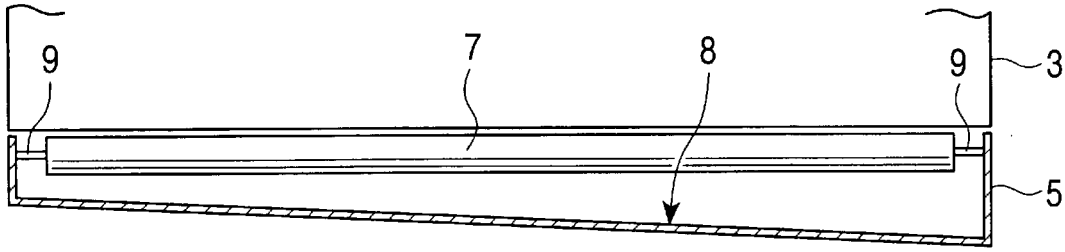
FIG. 11 schematically illustrates still another form of the ink receiving section of the head cap.

FIG. 11 schematically illustrates still another form of the ink-receiving section 8 provided at the head cap 5. In this form, the receiving surface of the ink-receiving section 8 is formed into an inclined surface that inclines towards one side in the longitudinal direction of the ink discharge surfaces 6 of the print head 4. The inclined surface is means for preventing ink that has been preliminarily discharged from the print head 4 from being spattered back. The preliminarily discharged ink flows along the inclined surface and collects at an end at one side of the inclined surface, so that the receiving surface of the ink-receiving section 8 is maintained in a clean state. By this, any ink remaining on the receiving surface after a previous preliminary discharge operation is spattered back by the currently preliminarily discharged ink in order to eliminate the possibility of the residual ink re-adhering to the ink discharge surfaces 6 of the print head 4. As shown in FIG. 10, the receiving surface of the inclined ink-receiving section 8 may be formed into a rough surface.

Figure 12A:
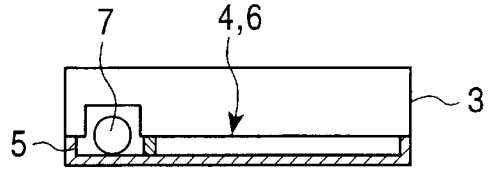
FIGS. 12A to 12F illustrate a cleaning operation using the cleaning roller and the head cap of the inkjet head.

Next, a description of the cleaning operation by the cleaning roller 7 and the head cap 5 of the inkjet head 1 having a structure such as those described above will be given with reference to FIG. 12. Here, in the inkjet head 1 shown in FIG. 6, the head cap 5 moves in the direction of arrow A in order to clean the ink discharge surfaces 6 of the print head 4, after which a preliminary discharge operation of ink is carried out. FIG. 12A shows an initial state in which the head cap 5 is placed on the ink cartridge 3. From the state shown in FIG. 1, the inkjet head 1 is accommodated and set in the printer body 2.

Figure 12B:
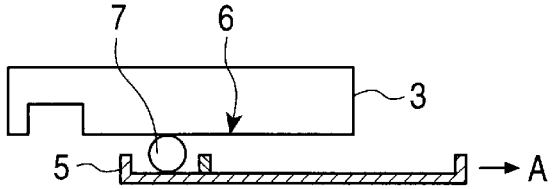

Next, with the inkjet head 1 being set in the printer body 2, as shown in FIG. 12B, the head cap 5 is moved in the direction of arrow A relative to the ink cartridge 3 by a head cap removal signal. This causes the cleaning roller 7 to move in the direction of arrow A along with the head cap 5 with respect to the ink cartridge 3, so that, with the cleaning roller 7 being pushed against and brought into contact with the ink discharge surfaces 6 of the print head 4, the ink discharge surfaces 6 are cleaned. At this time, the cleaning roller 7 is driven and rotates while it is in contact with any one the ink discharge surfaces 6, the cleaning roller 7 is fixed, the rotation of the cleaning roller 7 is limited by a braking mechanism, or the cleaning roller 7 moves while being rotated in the forward or back direction by a motor.

In this state, in FIG. 6, of the ink discharge surfaces 6 of the print head 4, for example, the yellow Y ink discharge surfaces 6 is cleaned. Here, the yellow Y portion of the position detection sheet 14, provided at the bottom surface of the head cap 5, moves to a detection location of the photoelectric switch 15 in order to detect that the cleaning of the yellow Y ink discharge surface 6 is completed. This causes a preliminary discharge start signal to be sent to the ink discharge hole of the yellow Y ink discharge surface.

Figure 12C:
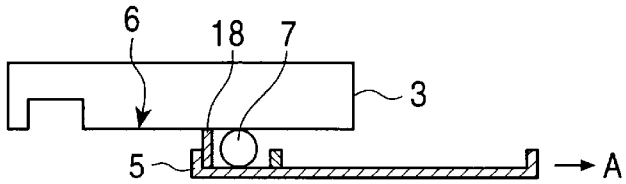

Next, as shown in FIG. 12C, preliminary discharge ink 18 is ejected from the ink-discharge hole of the yellow Y ink discharge surface 6. Then, a preliminary discharge completion signal is sent to the ink-discharge hole of the yellow Y ink discharge surface 6 in order to stop the ejection of the preliminary discharge ink 18. Thereafter, similarly, in FIG. 6, each time the cleaning roller 7 successively finishes cleaning each of the M, C, and K ink discharge surfaces 6, the photoelectric switch 15 detects completion of the cleaning of each of the ink discharge surfaces 6 in order to send a preliminary discharge start signal and a preliminary discharge completion signal to each of the ink-discharge holes. By this, a timing of the preliminary discharge operation from each of the ink-discharge holes is controlled, so that the ink preliminary discharge operations are successively carried out.

Figure 12D:
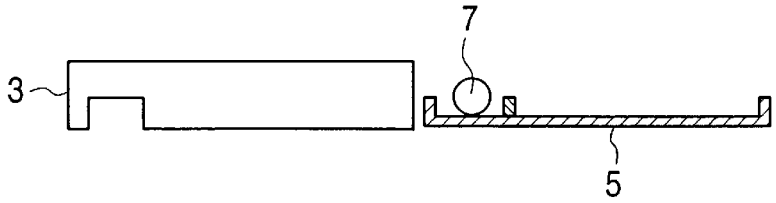

In this way, when the cleaning of and the preliminary discharge operation from each of the colored ink discharge surfaces 6 end, as shown in FIG. 12D, the head cap 5 moves maximally in the direction of arrow A, moves slightly upward, and settles in a withdrawal position. In this state, printing or photographic printing is performed on a recording sheet.

Figure 12E:
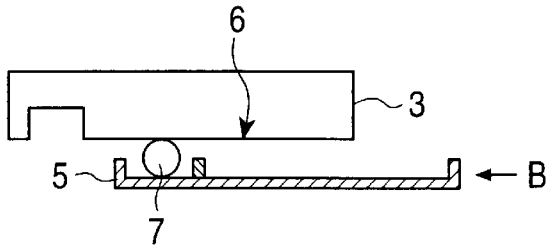

Next, when the printing or photographic printing on a required number of pages is completed, a head cap placing signal is transmitted, so that, as shown in FIG. 12E, the head cap 5 moves in the direction of arrow B relative to the ink cartridge 3 from the aforementioned withdrawal position. This causes the cleaning roller 7 to move in the direction of arrow B along with the head cap 5 with respect to the ink cartridge 3, so that, with the cleaning roller 7 being pushed against and coming into contact with the ink discharge surfaces 6 of the print head 4, the cleaning roller 7 moves back while cleaning the ink discharge surfaces 6.

Figure 12F:
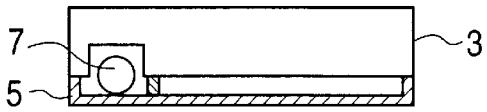

Thereafter, as shown in FIG. 12F, the head cap 5 moves maximally in the direction of arrow B with respect to the ink cartridge 3, and covers the ink cartridge 3, thereby returning to its initial state. Then, the printer waits for the next printing or photographic printing command.

The above-described operations have been described as being carried out when the ink preliminary discharge operations are carried out after cleaning the ink discharge surfaces 6 of the print head 4. However, if there is no possibility of a mixing of colors by the cleaning roller 7 that comes into contact with the ink discharge surfaces 6, the preliminary discharge of ink may be carried out before cleaning the ink discharge surfaces 6 by the cleaning roller 7. In this case, it is not necessary to control the timing of the preliminary discharge operation from each of the Y, M, C, and K colored ink discharge holes, or to provide the position detection sheet 14 and the photoelectric switch 15 shown in FIG. 6.

Next, a description of an inkjet printer as a related invention of the inkjet head will be described with reference to FIG. 1 and FIGS. 13 to 19. The inkjet printer performs printing by forming ink from the inkjet head into very fine particles and discharging them, and blowing ink dots onto a recording sheet. As shown in FIG. 1, it comprises the inkjet head 1, the printer body 2, a head mounting-and-dismounting mechanism 19, and a head cap placing-and-removing mechanism 20. The inkjet printer is shown as a type in which the inkjet head 1 is directly mounted to the printer body 2.

The inkjet head 1 forms liquid ink into very fine particles by, for example, electrothermal conversion or electromechanical conversion, and discharges the very fine particles in order to blow ink dots onto a recording sheet. Therefore, the inkjet head 1 has the same structure as that described in FIGS. 1 to 12.

The printer body 2 is provided to function as an inkjet printer by mounting the inkjet head 1 to a predetermined location thereof, and comprises a recording-sheet tray, a recording-sheet transporting system, an operational driving system, and a control circuit portion for controlling the entire printer body 2. In FIG. 1, reference numeral 21 denotes a discharged-sheet receiver to which sheets are discharged after printing.

The head mounting-and-dismounting mechanism 19 is provided to mount the inkjet head 1 to and dismount it from a predetermined location of the printer body 2, and comprises, for example, an elongated bar member which holds down the top surface portion of the inkjet head 1 by insertion of the inkjet head 1 into the predetermined location, that is, a recess in the center portion of the printer body 2. In other words, the head mounting-and-dismounting mechanism 19 extends in the direction of the entire width of the printer body 2, and is such as to be, for example, raised and lowered in the vertical and the horizontal directions, respectively. With the bar member being raised in the vertical direction as shown in FIG. 1, the inkjet head 1 is accommodated and mounted in the direction of arrow H, and, with the bar member being lowered in the horizontal direction as shown in FIG. 13, the inkjet head 1 is secured to the predetermined location.

With the inkjet head 1 being secured to the predetermined location of the printer body 2, the head cap placing-and-removing mechanism 20 causes the head cap 5 to move relative to the print head 4 (see FIG. 2) in order to uncover the ink discharge surfaces 6 (see FIG. 2), and causes the head cap 5 to be placed on the print head 4 after printing. The head cap placing-and-removing mechanism 20 is formed by, for example, engaging a pinion 23 and a rack 22, both of which are provided at a side surface of the printer body 2. A pin-like protrusion is provided at a side surface at the inner side of the rack 22, and is fitted to a recess formed in a corresponding portion of the outer-side surface of the head cap 5.

Figure 13:
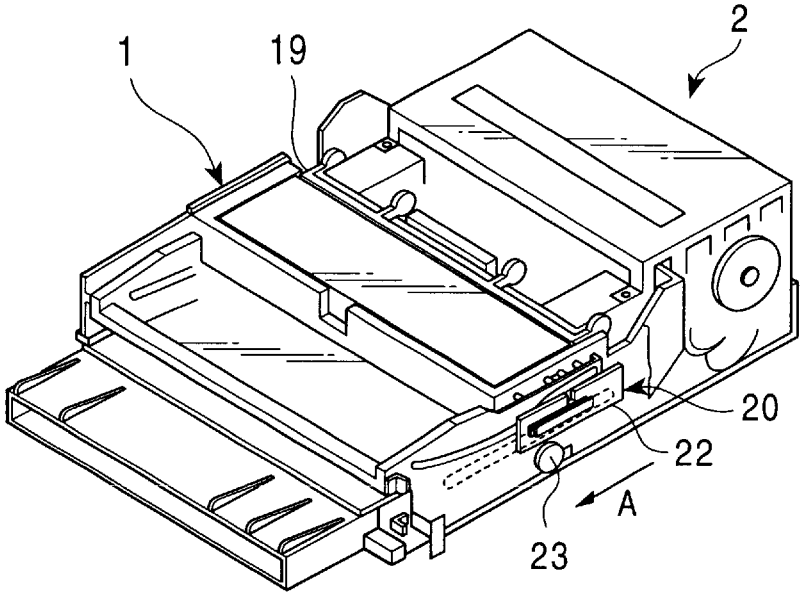
FIG. 13 is a perspective view of an inkjet printer of an embodiment of the present invention in which the inkjet head is mounted.
Figure 14:
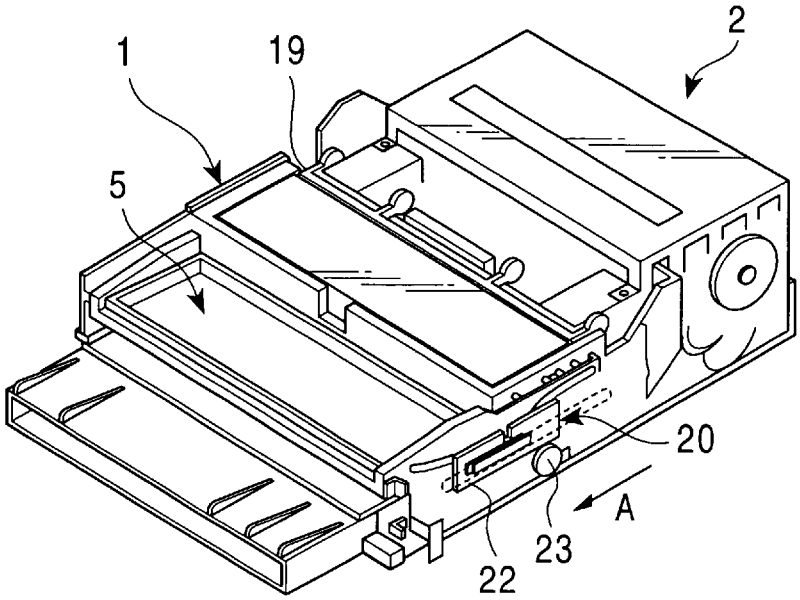
FIG. 14 is a perspective view similarly showing the inkjet printer of the embodiment of the present invention in which the head cap is removed.

As shown in FIG. 13, with the inkjet head 1 being secured to the predetermined location of the printer body 2 by the head mounting-and-dismounting mechanism 19, when the pinion 23 is rotated in a predetermined direction by a motor (not shown), as shown in FIG. 14, the rack 22 moves in the direction of arrow A, causing the head cap 5 shown in FIG. 1 to move in the direction of arrow A, to be removed, and to settle in the withdrawal position.

The head cap placing-and-removing mechanism 20 is not limited to an engagement of the rack 22 and the pinion 23. For example, there may be used another head cap placing-and-removing mechanism in which a rubber roller pushes against both side surfaces of the head cap 5, a motor is connected to a rotary shaft of the rubber roller, and the motor is rotated in order to move the head cap 5 in the direction of arrow A by friction of the rubber roller and to remove it.

Next, with reference to FIGS. 15 to 19, there will be described a specific example of a mechanism used to uncover the ink discharge surfaces 6 (see FIG. 2) by moving the head cap 5 relative to the print head 4 (see FIG. 2) after securing the inkjet head 1 to the predetermined location of the printer body 2 shown in FIG. 1.

Figure 15:
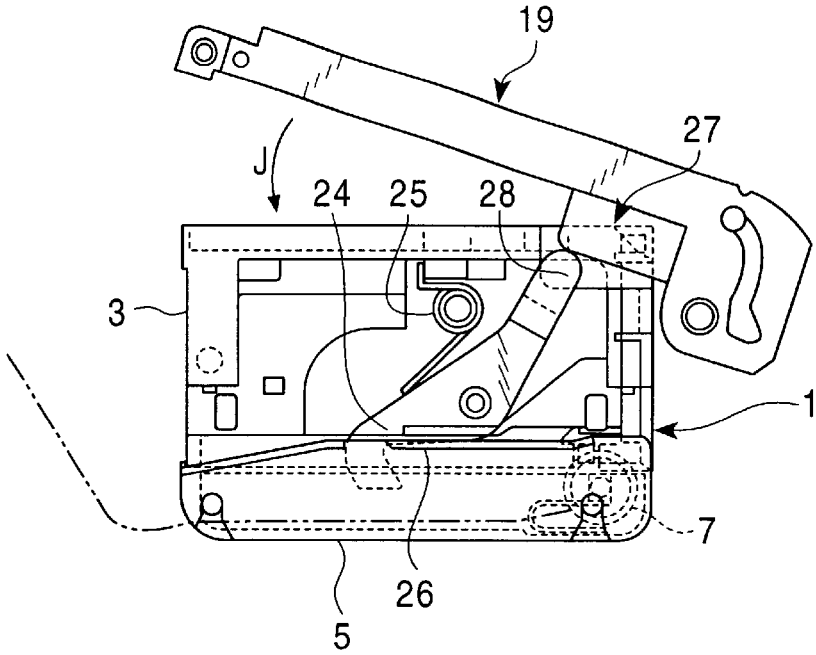
FIG. 15 illustrates a specific mechanism in which the inkjet head shown in FIG. 1 is accommodated in a predetermined location of the printer body as a result of insertion thereof in the direction of arrow H, and an operation thereof.

FIG. 15 shows a state in which the inkjet head 1 shown in FIG. 1 is accommodated in the predetermined location of the printer body 2 by insertion thereof in the direction of arrow H. In this state, the bottom ends of cap lock hooks 24 provided at both side end portions inside the inkjet head 1 engage corresponding stopper portions 26 at both side portions of the head cap 5 by a resilient force of a helical spring 25. By this, the head cap 5 is integrally mounted to the ink cartridge 3.

Figure 16:
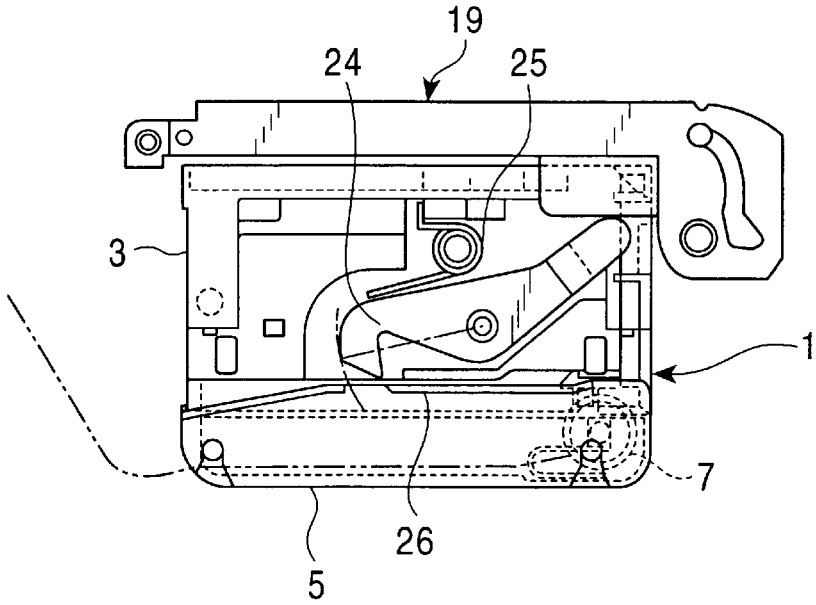
FIG. 16 illustrates the specific mechanism in which the inkjet head is secured to the predetermined location of the printer body by a head mounting-and-dismounting mechanism and in which the head cap is made movable, and an operation thereof.

In this state, in FIG. 15, the head mounting-and-dismounting mechanism 19 is pushed down in the direction of arrow J and is secured. This causes a cap unlocking portion 27 provided at the bottom side portion of the head mounting-and-dismounting mechanism 19 to push down and rotate top end portions 28 of the cap lock hooks 24. As shown in FIG. 16, this causes the bottom end portions of the cap lock hooks 24 to be lifted in order to disengage them from the corresponding stopper portions 26 at both side portions of the head cap 5. By this, as shown in FIG. 13, the inkjet head 1 is secured to the predetermined location of the printer body 2 by the head mounting-and-dismounting mechanism 19, and the head cap 5 becomes movable.

Figure 17:
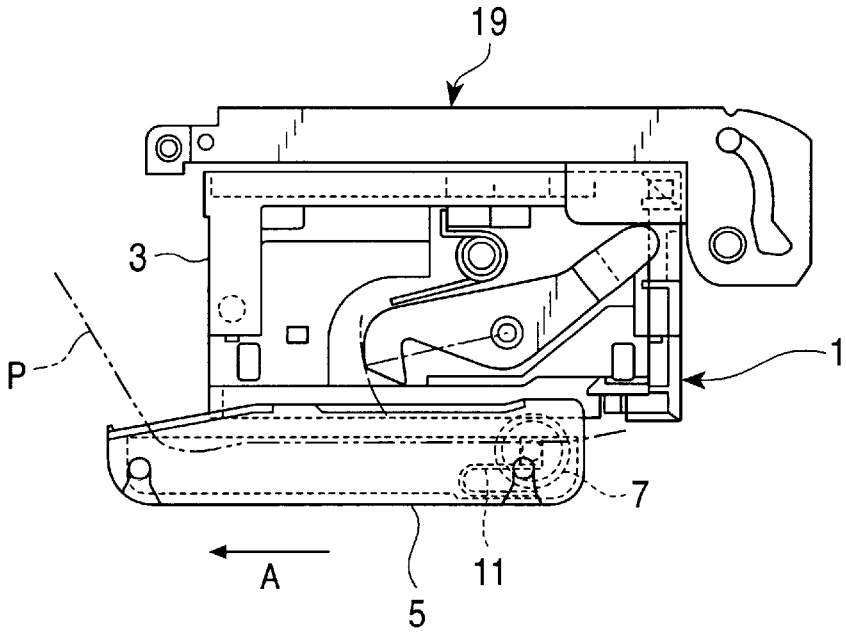
FIG. 17 illustrates the specific mechanism in which the head cap mounted to the bottom surface of an ink cartridge is being removed as a result of movement thereof in the direction of arrow A, and an operation thereof.

Next, the head cap placing-and-removing mechanism 20, shown in FIG. 13, is operated in order to rotate the pinion 23 by a motor (not shown) and to move the rack 22 in the direction of arrow A. As shown in FIG. 17, this causes the head cap 5, mounted to the bottom surface of the ink cartridge 3, to move, along with the rack 22, in the direction of arrow A and to be subjected to a removing operation. Then, as shown in FIG. 2, the cleaning roller 7 biased by the floating spring 11 starts cleaning the ink discharge surfaces 6 of the print head 4 provided at the bottom surface of the ink cartridge 3. In FIG. 17, reference character P denotes a path of movement of the head cap 5.

Figure 18:
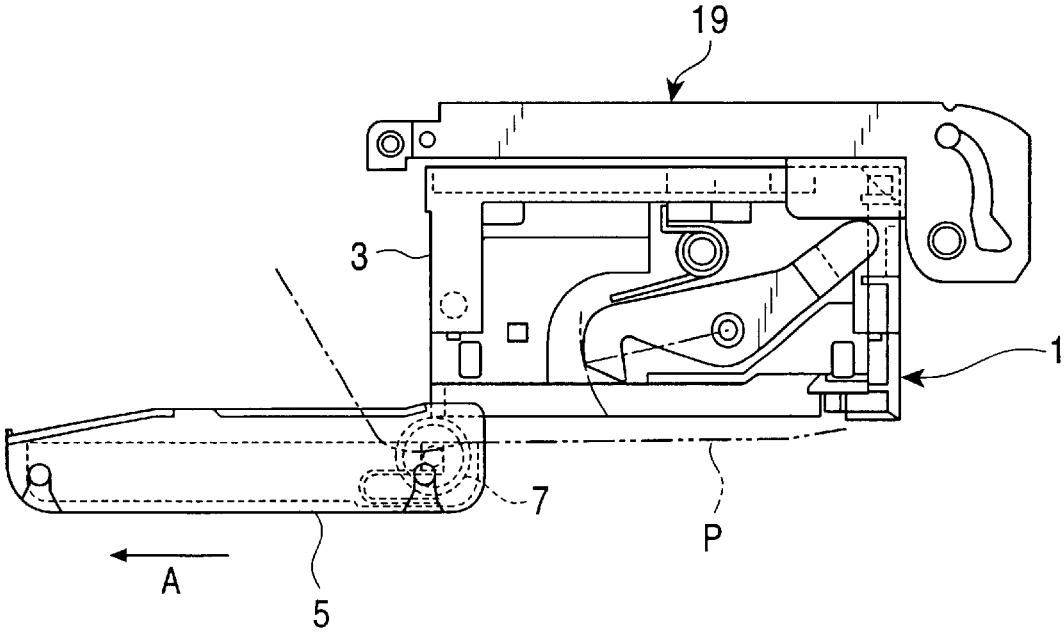
FIG. 18 illustrates the specific mechanism in which the head cap successively moves in the direction of arrow A along a movement path P, and an operation thereof.

Thereafter, as shown in FIG. 18, the head cap 5 moves successively in the direction of arrow A along the movement path P. At this time, by the cleaning roller 7 mounted to the head cap 5, each of the Y, M, C, and K colored ink discharge surfaces 6, shown in FIG. 2, are successively cleaned, and preliminary discharge operations of ink are carried out before or after the cleaning operation.

Figure 19:
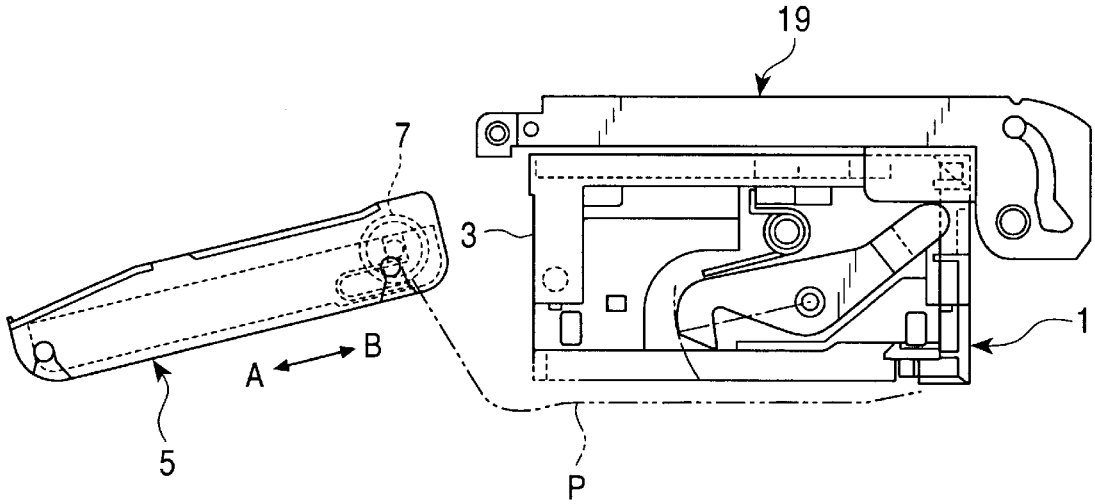
FIG. 19 illustrates the specific mechanism in which the head cap is at a withdrawal position as a result of maximally moving in the direction of arrow A along the movement path P, and an operation thereof.

When the cleaning of and the preliminary discharge from each of the colored ink discharge surfaces 6 are completed, as shown in FIG. 19, the head cap 5 moves maximally in the direction of arrow A along the movement path P and is moved slightly upward, so that it settles in the withdrawal position, as shown in FIG. 14. In this state, printing or photographic printing is carried out on a recording sheet. At this time, since, as shown in FIG. 19, the head cap 5 is moved slightly upward, the space required to accommodate it can be made small. In FIG. 19, although the recording sheet passes below the printer head 4 provided at the bottom surface of the ink cartridge 3, the passage of the recording sheet may be guided by the bottom surface of the head cap 5. In this case, a rib for guiding the recording sheet may be provided at the bottom surface of the head cap 5. A water-repellency process may be carried out so that ink does not stick onto the recording sheet that has been subjected to printing.

In this state, when the printing or photographic printing of a required number of pages is completed, the head cap 5 moves in the direction of arrow B from the withdrawal position shown in FIG. 19 by the above-described operations performed in reverse order, and, as shown in FIG. 16, the head cap 5 returns to its initial state by returning to the bottom surface of the ink cartridge 3.

Then, in FIG. 15, when the head mounting-and-dismounting mechanism 19 opens in a direction opposite to the direction of arrow J, the cap lock hooks 24 engage the stopper portions 26 at both side portions of the head cap 5 by the resilient force of the helical spring 25, so that the head cap 5 is integrally mounted to the ink cartridge 3. In this state, as shown in FIG. 1, the inkjet head 1 can be removed from the printer body 2.

With the head cap 5 being at the withdrawal position shown in FIG. 19, when a power supply of the printer is turned off for some reason, the head cap 5 remains at the aforementioned withdrawal position. In this state, as shown in FIG. 15, when the head mounting-and-dismounting mechanism 19 opens in a direction opposite to the direction of arrow J, the ink cartridge 3 alone is removed with the head cap 5 remaining at the withdrawal position. To prevent this, an interlock mechanism may be provided to cause the head cap 5 at the withdrawal position to automatically return to its initial position shown in FIG. 15 when the power supply of the printer is turned off for some reason, or to prevent the head mounting-and-dismounting mechanism 19 from opening in a direction opposite to the direction of arrow J when the head cap 5 has not returned to its initial position shown in FIG. 15.

The inkjet printer illustrated in FIGS. 13 to 19 is of the type in which the inkjet head 1 is directly mounted to the printer body 2. However, the present invention is not limited thereto, so that an inkjet printer of the type in which the inkjet head 1 is mounted to the printer body 2 through a tray may similarly be used. Hereunder, a general description of another type of inkjet printer will be given with reference to FIG. 20.

Figure 20A:
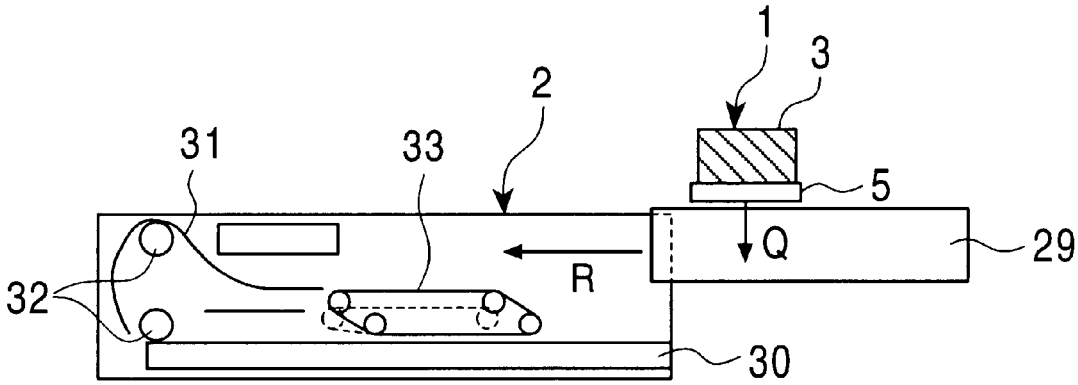
FIGS. 20A and 20B schematically illustrate another type of inkjet printer having the inkjet head mounted to the printer body through a tray.
Figure 20B:
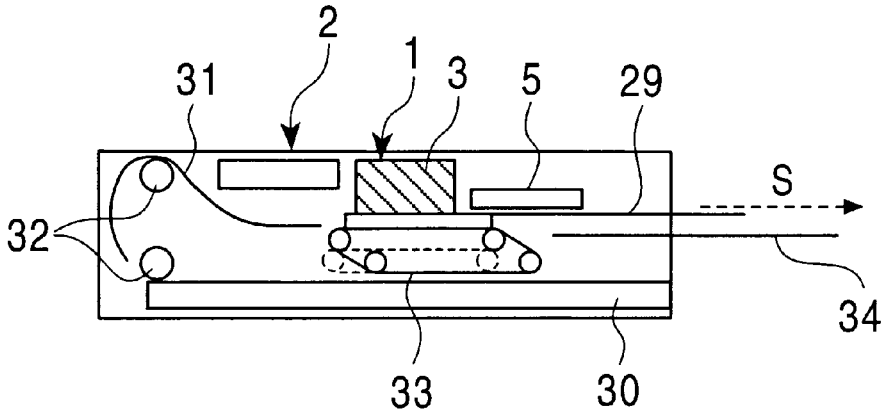

As shown in FIG. 20A, the inkjet head 1 that includes the head cap 5 integrally mounted to the ink cartridge 3 is mounted in the direction of arrow Q to a predetermined location at the inner side of a tray 29 which is provided so that it can advance and retreat with respect to the printer body 2. Thereafter, the tray 29 is moved in the direction of arrow R and is set inside the printer body 2. At this time, as shown in FIG. 20B, while the tray 29 is moving in the direction of arrow R, the head cap 5 is retained and stopped by proper retaining means provided inside the printer body 2. The tray 29 is provided for setting the inkjet head 1 inside the printer body 2 and for replacing it.

Thereafter, by moving the tray 29 in the direction of arrow R, the ink cartridge 3 moves in the direction of arrow R relative to the head cap 5, so that the head cap 5 is subjected to a removing operation. At the same time, by performing the same operations as those illustrated in FIG. 12 while the head cap 5 is moving in the direction of arrow R relative to the ink cartridge 3, the ink discharge surfaces 6 of the print head 4 are cleaned and preliminary discharge operations of ink are carried out. Thereafter, printing or photographic printing is carried out on a recording sheet. In FIG. 20, reference numeral 30 denotes a recording sheet tray, reference numeral 31 denotes a recording sheet, reference numeral 32 denotes a feed roller, reference numeral 33 denotes a feed belt, reference numeral 34 denotes a sheet-discharge tray, and reference character S denotes the direction in which the recording sheet is discharged.

In this type of inkjet printer shown in FIG. 20, the means for detecting a timing of a preliminary discharge operation from each ink discharge hole of the print head 4 shown in FIG. 6 is provided at the side of the ink cartridge 3 that moves in the direction of arrow R. In other words, in FIG. 6, the position detection sheet 14 may be provided at the top surface side of the ink cartridge 3, and the photoelectric switch 15 may be provided above the ink cartridge 3 and inside the printer body 2 so as to oppose the position detection sheet 14.

What is claimed is:

1. A inkjet head comprising:

an ink cartridge for holding ink of one color or of a plurality of colors therein;

a print head including an ink discharge surface including an ink discharge hole for discharging ink supplied from the ink cartridge;

a head cap, which moves relative to and is removably mounted to the print head, for protecting the ink discharge surface of the print head; and a cleaning member, provided at a print-head side of the head cap in a longitudinal direction of the print head, for cleaning the ink discharge surface of the print head.

2. An inkjet head according to claim 1, wherein the head cap is moved in a relative manner in a direction orthogonal to a longitudinal direction of the ink discharge surface of the print head in order to clean the ink discharge surface by the cleaning member which moves along with the head cap.

3. An inkjet head according to claim 1, wherein the print head preliminarily discharges ink from the ink discharge hole before or after cleaning the ink discharge surface by the cleaning member.

4. An inkjet head according to claim 3, further comprising an ink receiving section, provided at an inner side of the head cap, for receiving the ink preliminarily discharged from the ink discharge hole.

5. An inkjet head according to claim 3, further comprising means for detecting a timing of the preliminary discharge from the ink discharge hole of the print head when the head cap moves relative to the print head, the means being provided at either the ink cartridge or the head cap.

6. An inkjet head according to claim 1, wherein the cleaning member is formed with a circular cylindrical shape that comes into contact with the entire length of the ink discharge surface of the print head, and is removably held by the head cap.

7. An inkjet head according to claim 6, wherein a portion of the cleaning member that comes into contact with the ink discharge surface is resilient and is formed of an ink absorbing material.

8. An inkjet head according to claim 6, further comprising means for biasing the cleaning member towards the ink discharge surface of the print head, the means being provided at a portion where the cleaning member is held by the head cap.

9. An inkjet head according to claim 6, wherein the cleaning member is secured so as not to rotate when the cleaning member is in contact with the ink discharge surface of the print head, or rotation of the cleaning member is limited by a braking mechanism so that the cleaning member rotates while rubbing against the ink discharge surface.

10. An inkjet head according to claim 6, wherein the cleaning member is driven and rotates by coming into contact with the ink discharge surface of the print head, or wherein the cleaning member rotates in a forward direction or a backward direction by a rotational driving mechanism.

11. An inkjet head according to claim 6, wherein a cross-sectional peripheral length of the cleaning member is equal to a movement distance covered by the cleaning member when the cleaning member is driven and rotates by coming into contact with the ink discharge surface of the print head.

12. An inkjet head according to claim 4, further comprising means for preventing the preliminarily discharged ink from being spattered back, the means being provided at a receiving surface of the ink receiving section.

13. An inkjet printer for carrying out a printing operation by forming ink from an inkjet head into very fine particles and discharging the very fine particles in order to blow ink dots on a recording sheet, the inkjet printer comprising:

the inkjet head which comprises an ink cartridge for holding ink of one color or of a plurality of colors therein; a print head including an ink discharge surface including an ink discharge hole for discharging ink supplied from the ink cartridge; a head cap, which moves relative to and is removably mounted to the print head, for protecting the ink discharge surface of the print head; and a cleaning member, provided at a print-head side of the head cap in a longitudinal direction of the print head, for cleaning the ink discharge surface of the print head;

a head mounting-and-dismounting mechanism for mounting and securing the inkjet head to a predetermined location of a printer body and for dismounting the inkjet head from the predetermined location of the printer body; and a head cap placing-and-removing mechanism for uncovering the ink discharge surface and for placing the head cap after completion of the printing operation by, with the inkjet head being secured to the predetermined location of the printer body, moving the head cap relative to the print head.

14. An inkjet printer according to claim 13, further comprising an ink receiving section, provided at an inner side of the head cap of the inkjet head, for receiving ink preliminarily discharged from the ink discharge hole.

* * * * *